United States Patent [19]

Tsutsui et al.

[11] Patent Number: 4,563,074

[45] Date of Patent: Jan. 7, 1986

[54] ENGAGEMENT MECHANISM FOR A DEVELOPING MEANS IN ELECTROSTATIC COPYING MACHINE

[75] Inventors: Eiji Tsutsui, Amagasaki; Masahiro Yoshioka, Matsubara; Masahiro Murakami, Shijonawate, all of Japan

[73] Assignee: Mita Industrial Co., Ltd., Japan

[21] Appl. No.: 675,170

[22] Filed: Nov. 27, 1984

[30] Foreign Application Priority Data

Nov. 28, 1983 [JP] Japan ..... 58-225239
Aug. 30, 1984 [JP] Japan ..... 59-181136

[51] Int. Cl.[4] ..... G03G 15/00

[52] U.S. Cl. ..... 355/3 DD; 355/3 R; 355/3 DR

[58] Field of Search ..... 355/3 R, 14 R, 3 DR, 355/3 DD

[56] References Cited

U.S. PATENT DOCUMENTS 4,327,992 5/1982 Babicz ..... 355/3 DR X
4,376,577 3/1983 Okamoto ..... 355/3 R X
4,462,677 7/1984 Onoda ..... 355/3 R
4,470,689 9/1984 Nomura et al. ..... 355/3 R

*Primary Examiner*—A. C. Prescott

*Attorney, Agent, or Firm*—Beveridge, De Grandi & Weilacher

[57] ABSTRACT

An engagement mechanism for a developing means in an electrostatic copying machine, wherein an original image is guided to a photoreceptor arranged on a rotary drum via a focusing device, forming an electrostatic latent image on the photoreceptor and the electrostatic latent image being positively changed into a toner image by the developing means, and the rotary drum is supported in a freely rotatable fashion by the supporting member at the supporting frame body which can be drawn out from a vertical front plate of the copying machine body and a contact surface controlling a horizontal position of the developing means and a guide controlling a vertical position are provided at a fixed position of the supporting member, and furthermore the engagement member rotatable to one direction from the standard position is provided movably toward the rotary drum at the standard position with a constant impetus thereto separately from the supporting member and the developing means is arranged movably toward the rotary drum by engaging an engagement part formed at a fixed position of the engagement member aforementioned with an engagement part formed at the fixed position of the development means.

13 Claims, 22 Drawing Figures

ENGAGEMENT MECHANISM FOR A DEVELOPING MEANS IN ELECTROSTATIC COPYING MACHINE

BACKGROUND OF THE INVENTION

The present invention relates to an engagement mechanism for a developing means in an electrostatic copying machine.

The electrostatic copying machine is, in a typical configuration, provided with a rotary drum which rotates once every copying operation at the center portion of the machine body in addition to an electrostatic charger, an exposure member, a developing means, a transfer charger, a separation charger and a cleaner are arranged successively in a peripheral of the rotary drum. Among the constituent elements the rotary drum and the developing means include some consumables having a certain life time which necessitate successive replacements in order to maintain a constant copying quality.

In the past, in order to meet with such requirements there were such copying machines, of which, (1) one is comprising upper and lower two sections, wherein one side of the upper section being pivotally supported while other side of the upper section being detached from the lower section, thus the constituent elements mentioned above can be removed by dividing a conveying section for a copying paper, and (2) another is comprising the rotary drum, developing means and cleaner which can be drawn out together in one unit from the machine body.

The former has an advantage of removing the constituent elements comparatively easily, since they can be removed by pivotally supporting one side of the upper section of the machine body while detaching the other side from the lower section and dividing the conveying section of the copying paper. It involves, however, considerably complicated works to ensure an accurate position between the rotary drum and the developing means. Particularly in the large electrostatic copying machine, it requires much trouble for pivotally supporting one side of the upper section while detaching the other side from the lower section and dividing the conveying section of the copying paper, resulting in a difficulty in replacing each constituent element. On the other hand the latter is free from a any disadvantages accompanied in the works for pivotally supporting one side of the upper section while detaching the other side from the lower section and dividing the conveying section of the copying paper, accordingly it is applicable to the large electrostatic copying machine.

With respect to the latter electrostatic copying machine the applicant of the present patent has filed a patent application already [refer to Japanese Patent Publication (unexamined) No. 181058/1983], of which configurations are shown in FIG. 21 and FIG. 22.

In other words, the supporting frame body (5') having the rotary drum (41') and the developing means (43') being removably mounted thereto is provided in such a manner that it may be drawn out through the opening (55') formed at the fixed center portion of the vertical front plate (18') of the copying machine body (1'). The rotary drum (41') and the developing means (43') are mounted between a pair of supporting walls (51') (52') which are mutually connected with the horizontal members (53') (53') and construct the supporting frame body (5') as described in detail in the followings.

The rotary drum (41') is provided with the discs (423) at the openings on both ends of a cylindrical body (422) having a photoreceptor layer (400') on an outer surface, a boss (not illustrated) extending outwardly from the disc (423) and a bearing member (415') to be arranged on the boss, whereby a positioning of the rotary drum (41') may be accomplished by setting the bearing member (415') on a receiving member (501') fixed on said supporting wall (51'). The developing means (43') includes a plate member (424) at the front and rear sides which is provided with a protruded portion (425) having a horizontal bottom contact edge (426) contacting the supporting member (415') at the end on the side of the rotary drum (41') together with a vertical contact edge (419') contacting a vertical contact surface (507') of the receiving member (501') at the edge (427) located beneath the protruded portion (425), whereby the relative position of the rotary drum (41') and the developing means (43') may be controlled by the bottom contact edge (426) and the contact edge (419').

A protrusion receiving part (522) is formed on the mounting body (520) positioned adjustably to the rotary drum (41') by a long hole (521) and a screw (not illustrated) against the supporting wall (51') and an accurate positioning against rotary drum (41') is performed by the contact bottom edge (426) and the contact edge (419') in a mating state between a mounting protrusion (421') protruded at the fixed position of said plate member (424) and the protrusion receiving part (522), whereby the accurate mounting of the developing means (43') may be accomplished by fixing the mounting body (520) by tightening the screw (not illustrated).

Accordingly, the developing means (43') may be set accurately by contacting the bottom contact edge (426) to the bearing member (415') of the rotary drum (41'), moving the developing means (43') so as to cause a contact between the contact edge (419') and the contact surface (507') in the mating state between the mounting protrusion (421') and the protrusion receiving part (522) and fixing the mounting body (520) by the screw (not illustrated).

After being set accurately, it has an advantage of simple removing work of the developing means (43') by lifting it upward to as to detach the mounting protrusion (421') from the protrusion receiving part (522) whenever an exchange of developing agent or a replacement of rotary drum is required.

It requires a certain amount of works, however, to fix the mounting body (520) by the screw (not illustrated) which causes an operational problem of preventing the incorrect positioning of the developing means (43') during such works, further when mounting the developing means (43') it may be required to approach the developing means (43') to the rotary drum (41') by confirming the relative positions of bearing member (415') vs. bottom contact edge (426), receiving member (501') vs. contact edge (419') and protrusion receiving part (522) vs. mounting protrusion (421') respectively with an eye measurement, whereby a problem of unexpected accident may occur such as an undesirable negative effect which causes a scratch on the photoreceptor layer (400') on the rotary drum (41') by the edge of the developing means (43'), e.g. the protrusion (425) etc.

Moreover, since the engagement of the developing means (43') is performed while the supporting frame body (5') being drawn out, it may happen that the supporting frame body (5') will be replaced carelessly with the developing means (43') being removed, accordingly if a copying is performed as it is a copied image may be not formed on the copying paper, that is, a problem of mis-copying will occur.

It is an object of the present invention to improve a performance by dispensing with the job of tightening the screw and prevention of incorrect positioning of the developing means resulted therefrom.

Still another object of this invention is to control the setting of the developing means to a certain direction in order to secure the uniformity of works.

Even still another object of the present invention is to surely preclude the mis-operation from setting the rotary drum with undue force on the main body of the copying machine in a state when the developing means is failed being set.

It is another object of the present invention to prevent an unexpected accident by exactly controlling the direction for mounting the developing means in a constant direction.

It is an additional object of the present invention to surely prevent a breakage-accident of the machine resulting from forcedly setting the rotary drum to the copying machine body in a state in which the developing means was failed to be incorporated.

It is a still further object of the present invention to simplify the engagement operation of the developing means in a state of the machine wherein the supporting frame body was drawn out.

The present invention relates to an electrostatic copying machine wherein the original image is guided onto the photoreceptor body arranged on the rotary drum via the focusing device, forming the electrostatic latent image on the photoreceptor, which is positively changed into the toner image by the developing means and said copying machine is provided with the supporting frame body which can be drawn out from the vertical front plate of the copying machine body and the supporting member and the engagement member separately arranged thereon, said supporting member supporting the rotary drum in a freely rotatable fashion and being provided with the contact surface for controlling the horizontal position of the developing means and the guide for controlling the vertical position thereof, said engagement member being rotatable in one direction from the standard position and being mounted movably with an impetus toward the rotary drum, further the developing means being arranged movably to the rotary drum by engaging the engagement part formed at the fixed position on the developing means to the engagement part provided at the fixed position on said engagement member.

DRAWINGS

Figure 9:
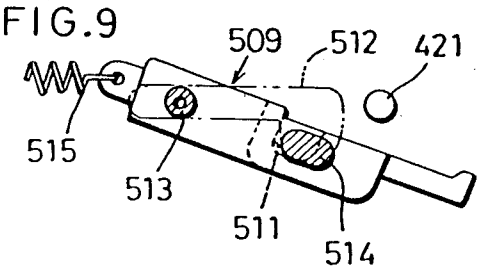
Figure 10:
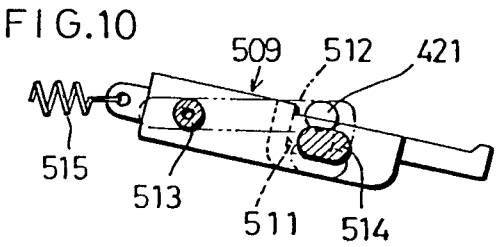
Figure 11:
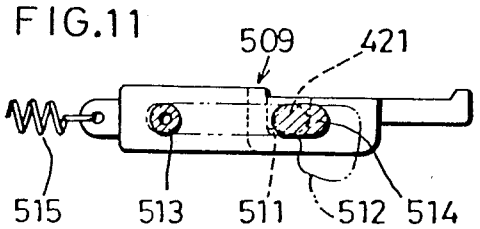

From FIG. 9 to FIG. 11 are explanatory drawings showing the mounting operation of the developing means.

Figure 12:
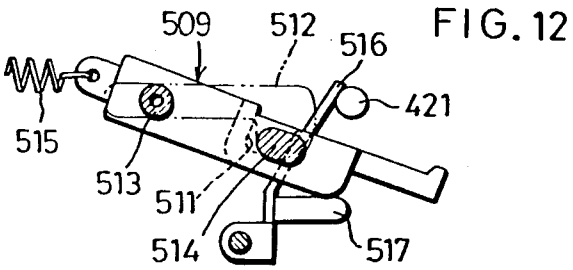
Figure 13:
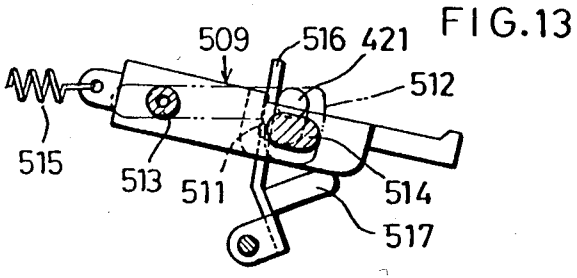
Figure 14:
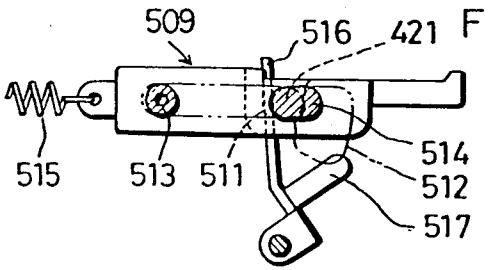

From FIG. 12 to FIG. 14 are explanatory drawings showing another embodiment of the mounting operation of the developing means.

Figure 15:
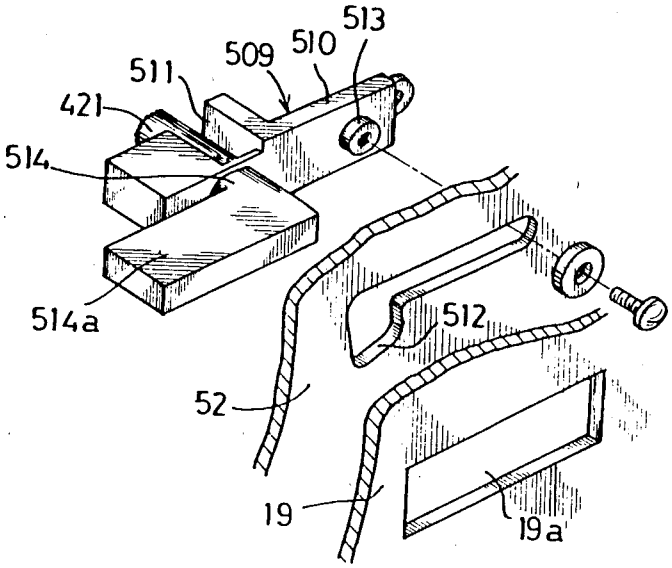

FIG. 15 is an exploded perspective view showing another embodiment of relation between the rear supporting wall of the supporting frame body and the engagement member.

Figure 16:
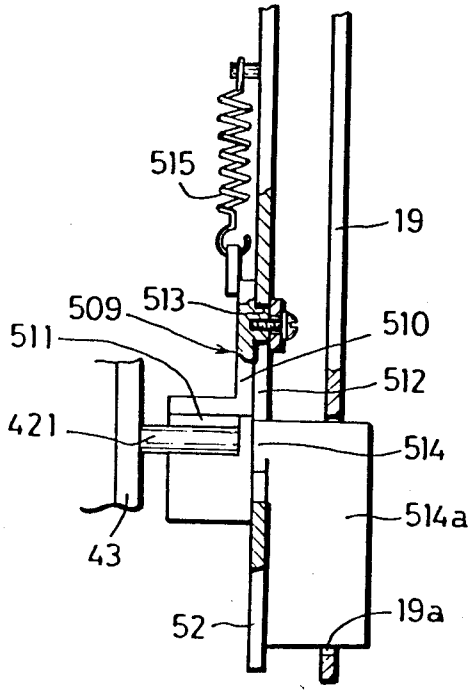

FIG. 16 is a partially transverse plan view of above.

Figure 17:
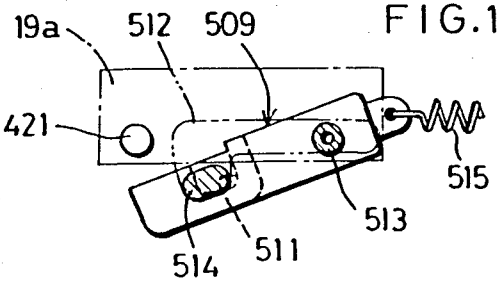
Figure 18:
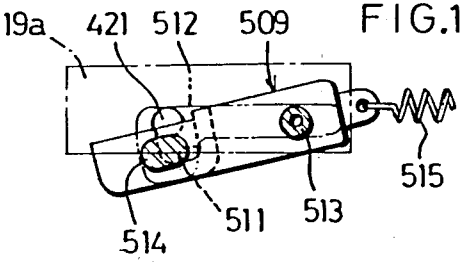
Figure 19:
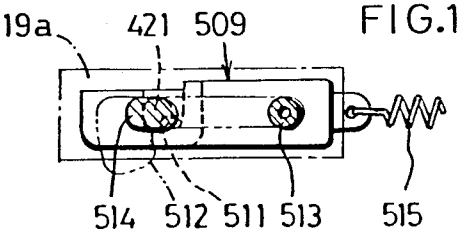

From FIG. 17 to FIG. 19 are explanatory drawings showing the mounting operation of the developing means.

Figure 20:
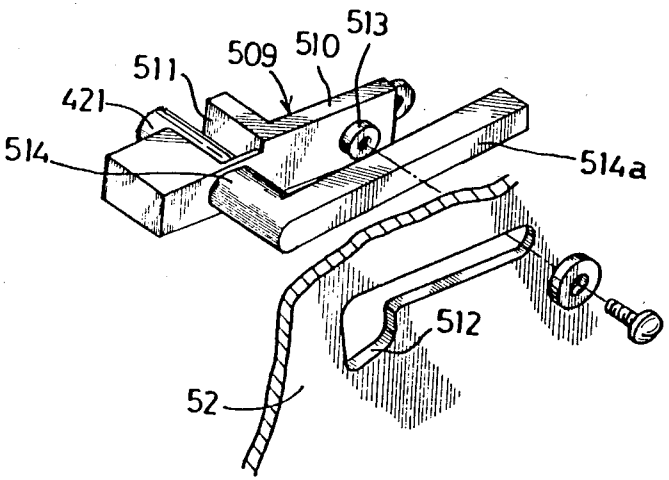

FIG. 20 is an exploded perspective view showing the relation between the rear supporting wall of the supporting frame body and the engagement member in another embodiment.

Figure 21:
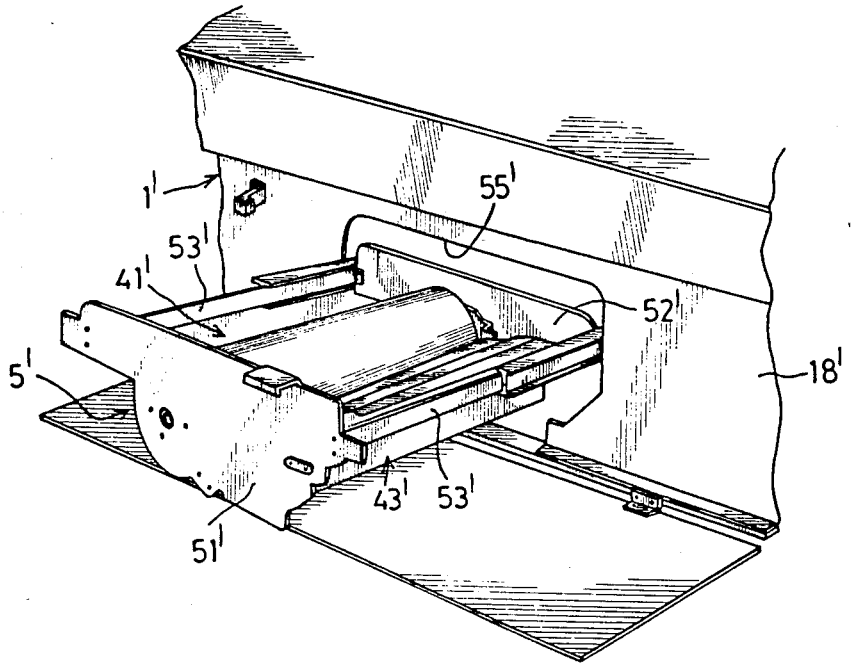

FIG. 21 is a perspective view showing a conventional embodiment.

Figure 22:
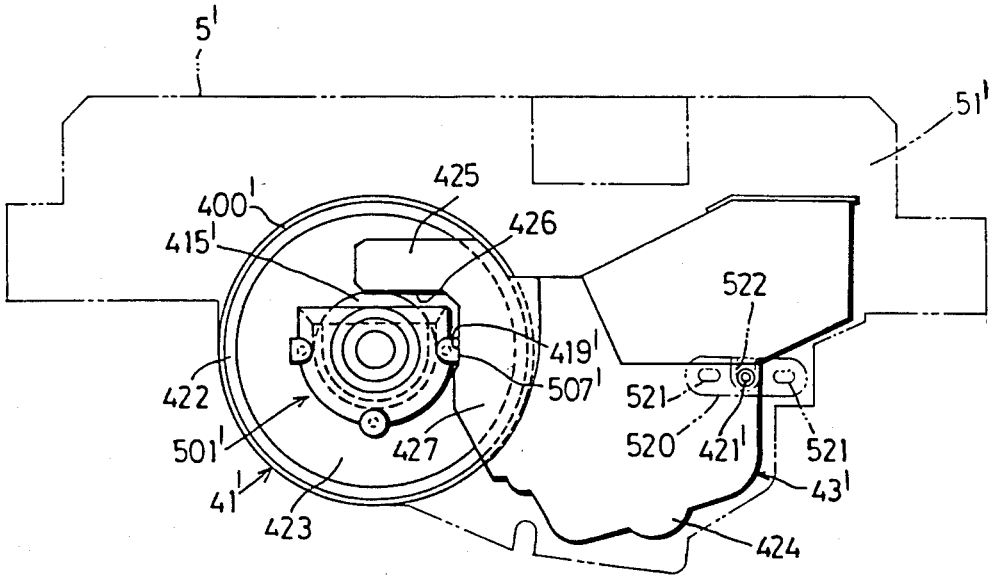

FIG. 22 is a plan view of above.

BRIEF DESCRIPTION OF THE PREFERRED EMBODIMENT

Figure 1:
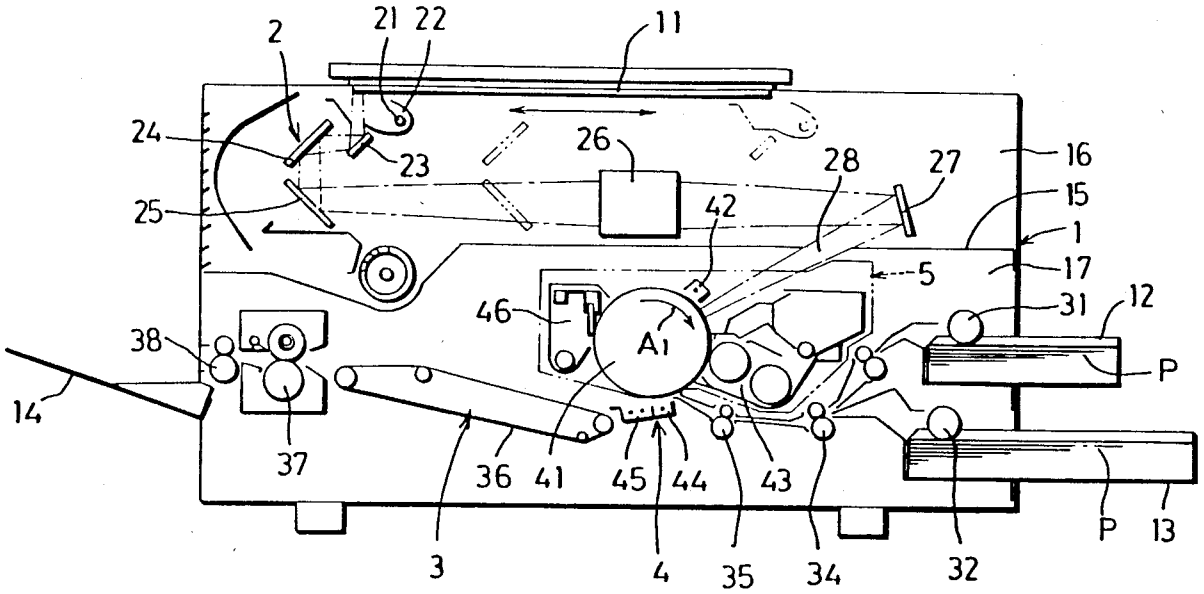
FIG. 1 is a schematic view showing an internal mechanism of an electrostatic copying machine.

FIG. 1, (1) is a copying machine body having an original plate (11) with an original cover on the upper surface together with two cassettes (12) (13) for copying paper feeding removably mounted at the lower portion on the right side and a copy receiving tray (14) for holding a copying paper (P) after the copying being provided at the fixed position on the left side. A partition plate (15) provided at an inner fixed position forms an upper chamber (16) and a lower chamber (17), wherein an optical system (2) is arranged in the upper chamber (16) and a copy treatment section (4) and a conveying section (3) are provided in the lower chamber (17).

The optical system (2) includes a light source (21), No. 1 reflector (22) having a concave reflecting surface, No. 2 reflector (23), No. 3 reflector (24), No. 4 reflector (25), a focusing device (26) comprising a lens etc. and No. 5 reflector (27), wherein the light source (21), No. 1 reflector (22) and No. 2 reflector (23) reciprocate once in every copying operation at high speed thereby enable a scanning exposure of the original on the original plate (11) successively, thus the reflected light from the original is irradiated on the surface of the rotary drum (41) to be described after passing through No. 3 reflector (24) and No. 4 reflector (25) which move slowly following the movements of the light source (21), No. 1 reflector (22) and No. 2 reflector (23), the focusing device (26), No. 5 reflector (27) and the slits (28) formed at the fixed positions on the partition plate (15).

The conveying section (3) for the copying paper comprises the feed rollers (31) (32) which feed the copying paper (P) to a resist roller (34) by taking out from the cassettes (12) (13) one by one, a conveying roller (35) which conveys the copying paper (P) from the resist roller (34) to the copy treatment section (4), a belt (36) which conveys the copying paper (P) separated from the copy treatment section (4), a heat fusing roller (37) which heats and fuses a toner image on the copying paper (P) and a delivery roller (38) which delivers the copying paper (P) heated and fixed to a copy receiving tray (14), wherein the copying paper (P) in the desired cassettes (12) or (13) may be fed one by one by driving the feed rollers (31) (32) selectively.

The copy treatment section (4) is provided at an approximately center portion in the lower chamber (17), wherein the rotary drum (41) which rotates by a fixed number of rotations in one direction (a direction shown by the arrow A1 in the drawing) in every copying operation is installed with an electrostatic charger (42), a developing means (43), a transfer charger (44), a separation charger (45) and a cleaner (46) being arranged in the peripheral thereof in that order. Accordingly, one copying operation may be accomplished by forming the electrostatic latent image corresponds to an original image by the irradiated light through the slit (28) after the photoreceptor on the outer surface of the rotary drum (41) being charged uniformly by the electrostatic charger (42), forming the toner image by absorbing the toner by the developing means (43), transfering the toner image on the copying paper (P) fed from the feeding roller (35) by the transfer charger (44), separating the copying paper (P) from the rotary drum (41) by the separation charger (45) and finally recovering the toner remained on the outer surface of the rotary drum (41) by the cleaner (46).

Figure 2:
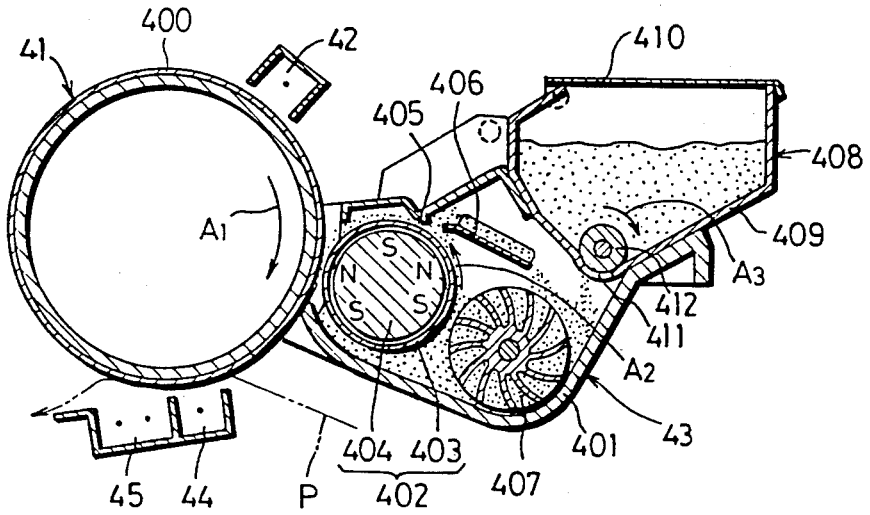
FIG. 2 is an enlarged vertical sectional view showing a copy treatment section.

Referring now to FIG. 2 in more detail, the developing means (43) comprises a developing housing (401) which includes a magnetic brush mechanism (402), a guide member (406) for developer and an agitating mechanism (407) for developer, and a supplier (408) for the toner particles attached to the upper part thereof.

Figure 3:
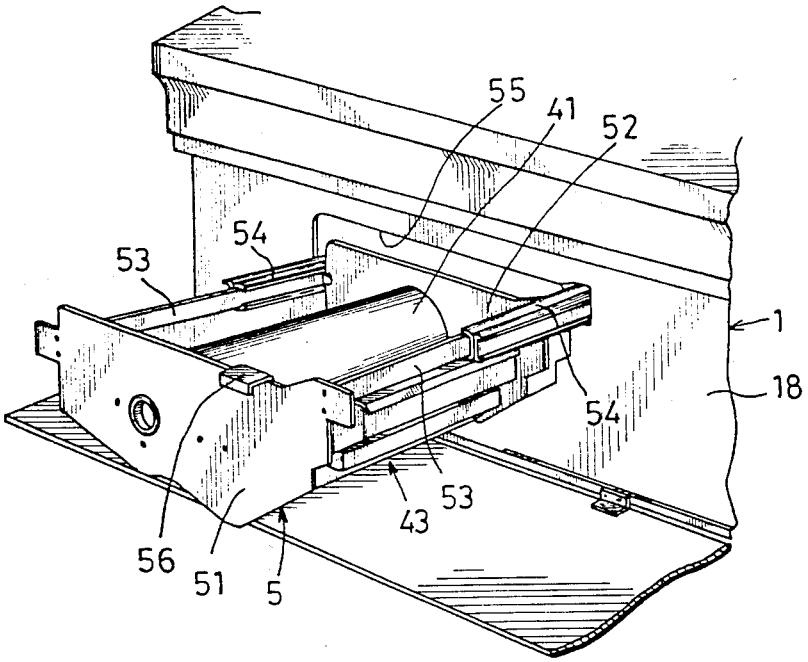
FIG. 3 is a perspective view showing a supporting frame body being drawn out.
Figure 4:
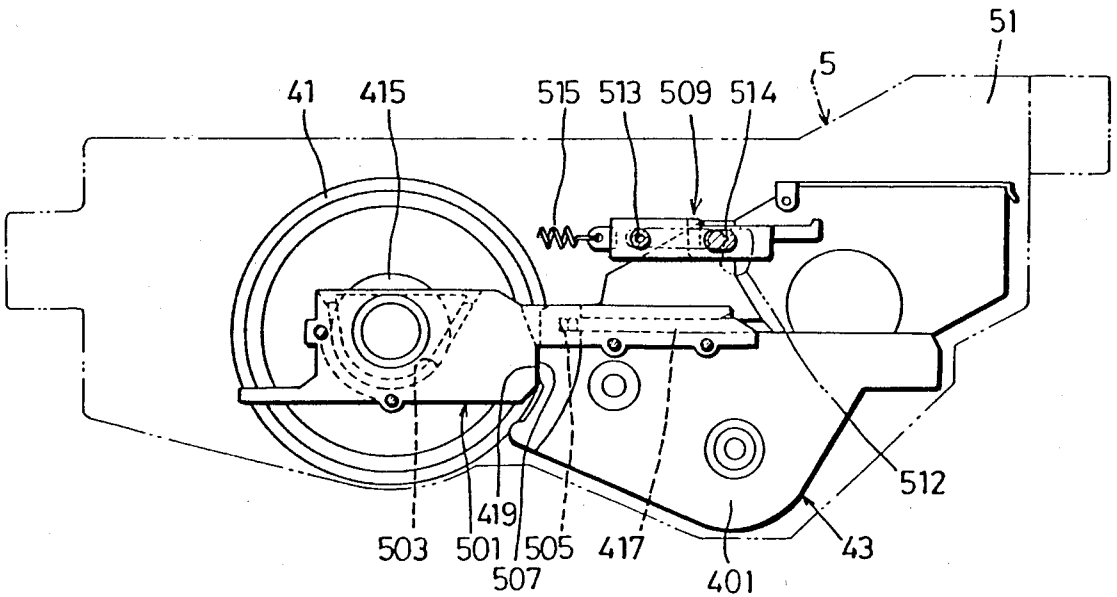
FIG. 4 is a front view showing a rotary drum and a developing means being arranged on the supporting frame body.
Figure 5:
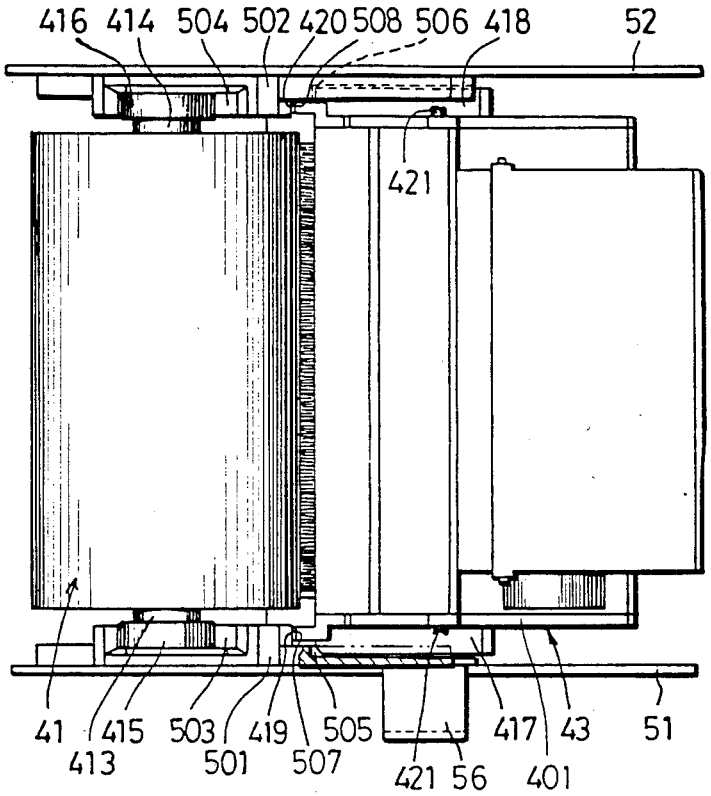
FIG. 5 is a partially cutaway plan view of above.
Figure 6:
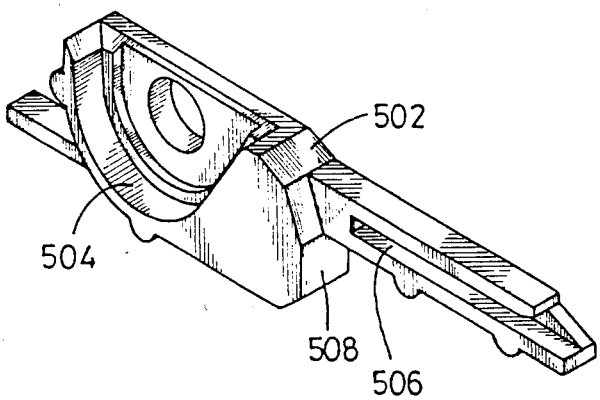
FIG. 6 is a perspective view of a supporting member.
Figure 8:
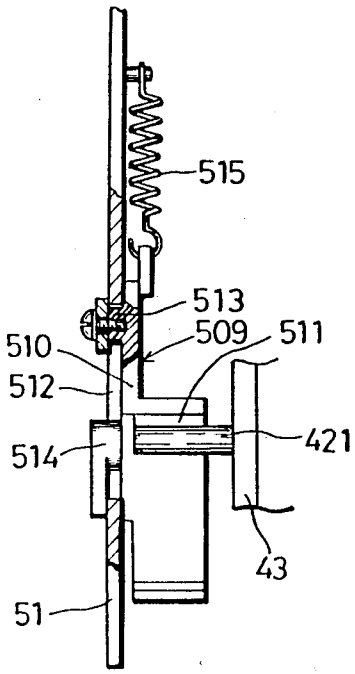
FIG. 8 is a partially transverse plan view of above.
Figure 7:
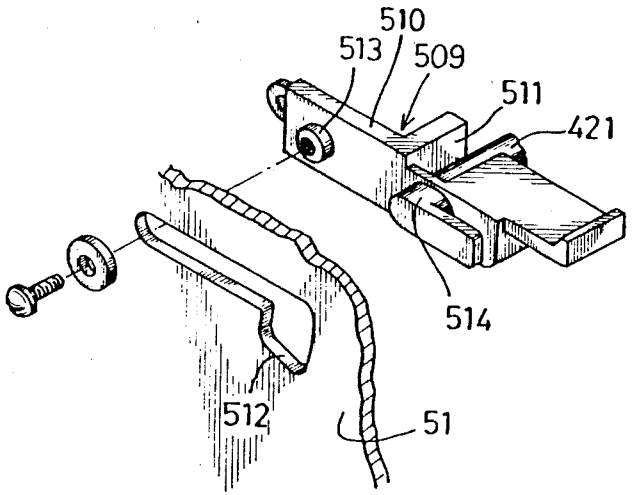
FIG. 7 is an exploded perspective view showing a relation between a front supporting wall of the supporting frame body and an engagement member.

The magnetic brush mechanism (402) aforementioned is provided adjacent to the external photoreceptor layer (400) on the rotary drum (41) and comprising a cylindrical sleeve member (403) rotatably driven in a direction shown by the arrow A2 having a roll-shaped static permanent magnet (404) arranged therein. Further, a thickness setting member (405) which suspends toward the magnetic brush mechanism (402) and appropriately sets a thickness of the developer layer magnetically retained on the outer surface of the sleeve member (403) is formed on the upper part of the developing housing (401). Moreover, the guide member (406) for the developer drops the developer peeled from the sleeve member (402) by the thickness setting member (405) to the agitating member (407) for the developer located at the rear side (right side in FIG. 2) of the magnetic brush mechanism (402). In the toner particles supplier (408) a toner discharge-port (411) is formed at the lower portion of the supplier body (409) having a cover (410) at the upper portion thereof, a toner particles supply roller (412) formed by a porous material such as a sponge etc. is mounted rotatably at the toner discharge-port (411) which drops the toner particles on the agitating mechanism (407) for the toner particles when the toner particles supply roller (412) will be rotated in a direction shown by the arrow A3 by a driving means not illustrated. The agitating mechanism (407) for the developer mixes and agitates the developer from the developer guide member (406) and the toner particles from the toner particles supplier (408), wherein the carrier particles in the developer and the toner particles are uniformly mixed whereas the latter being electrostatically charged by the friction before fed to the side of the magnetic brush mechanism (402). A numeral (5) is the supporting frame body provided in the lower chamber (17) of the copying machine body (1) which can be drawn out through the vertical front plate (18) (ref. FIG. 3), and supporting the rotary drum (41), the developing means (43) and the cleaner (46) keeping the accurate relative positions mutually.

Referring to FIG. 3 in more detail, the supporting frame body (5) comprises a front supporting wall (51) and a rear supporting wall (52) connected by the horizontal members (53) (53), wherein the engagement thereof is made possible for drawal and pushing-in by slidably engaging the horizontal members (53) (53) with the guide rails (54) (54) engaged slidably with the guide rails (not illustrated) provided in the lower chamber (17) of the copying machine body (1). On the vertical front plate (18) an opening (55) having a similar shape as the front supporting wall (51) is formed, whereby the supporting frame body (5) may be pushed in to the position where the surfaces of the front supporting wall (51) and the vertical front plate (18) form a common plane. A numeral (56) is a handle provided on the front supporting wall (51).

Referring in more detail to the mounting structures of the rotary drum (41) and the developing means (43) to the supporting fame body (5) in connection with FIG. 4 to FIG. 8, the supporting members (501) (502) facing each other are mounted at the center portions of the front supporting wall (51) and the rear supporting wall (52) of the supporting frame body (5) by screwing etc., the bearing member (415) (416) mounted on the bosses (413) (414) extending outwardly in an axial direction of the rotary drum (41) are supported by the cradles (503) (504) having a semicircular shape of each supporting members (501) (502), whereby the rotary drum (41) is positioned freely rotatably.

The vertical position of the developing means (43) against the rotary drum (41) may be accurately controlled and the developing means (43) may be moved to and from the rotary drum (41) along the guide grooves (505) (506) by engaging the protruded plate portions (417) (418) protruded from the front and rear walls of the developing housing (401) with the guide grooves (505) (506) arranged at the fixed position of the supporting members (501) (502) aformentioned adjacent to the cradles (503) (504).

The movement of the developing means (43) to the side of the rotary drum (41) is prevented and the relative position between the two is maintained accurately by contacting the contact surfaces (507) (508) formed at the fixed position on the supporting members (501) (502) to the contact edges (419) (420) formed respectively at the front and rear walls of the developing housing (401).

Further, on the upper sides of the guide grooves (505) (506) on each supporting members (501) (502) the engagement members (509) (In the drawing, only a side mounted to the front supporting wall (51) is shown) are mounted slidably and rotatably in a downward direction.

That is, on the engagement member (509) a concave (511) as an engagement part is formed which engages with an engagement pin (421) as the engagement part protruded from the front wall of the developing means (43) at the upper fixed position of the main body (510) having a fixed length and extending horizontally.

An axis (513) of the engagement member (509) is mounted on a approximately hook-shaped aperture (512) formed on the front supporting wall (51) of the supporting frame body (5) slidably and rotatably, whereas a control axis (514) is mounted slidably thereto. The engagement member (509) is movable toward the rotary drum (41) by the spring (515) with the rotating condition about the axis (513) to the upward by engaging the bent side of the hook-shaped aperture (512) with the control axis (514) and the other side with the axis (513), further it may rotate downwardly about the axis (513) with the sliding condition opposing the spring (515). It goes without saying that the vertical relative position between the supporting member (501) and the engagement member (509) is set in such a way that the concave (511) may engage with the engagement pin (421) by rotating the engagement member (509) upward with the engagement of the protruded plate portion (417) with the guide groove (505).

With the above configuration, after the rotary drum (41) being set to the supporting frame body (5), the engagement pin (421) contacts the concave (511) by rotating the engagement member (509) upwardly about the axis (513) with the engagement pin (421) positioned just above the concave (511) of the engagement member (509) (ref. FIG. 10) by engaging the protruded plate portions (417) (418) of the developing means (43) with the guide grooves (505) (506) and by moving it toward the rotary drum (41) (ref. FIG. 9), whereby the engagement member (509) and the developing means (43) may be moved toward the rotary drum (41) by the spring (515) (ref. FIG. 11).

Since the movement of the developing means (43) will be prevented by the contact between the contact surfaces (507) (508) and the contact edges (419) (420), the relative positions of the developing means (43) and the rotary drum (41) may be maintained accurately.

On the other hand, when dismounting the developing means (43) it may be drawn out after disengaging the engagement pin (421) from the concave (511) by pulling the engagement member (509) against the spring (515) and rotating downwardly about the axis (513).

As it is apparent from the above description, in the present embodiment a screwing operation or any other operations during the screwing such as securing the developing means at a fixed position etc. are not required, moreover, an uniformity in operation is ensured by controlling the mounting direction of the developing means in one direction thus eliminating a fear of damaging the rotary drum.

FIG. 12 to FIG. 14 are the drawings showing a mounting operation of the developing means in another embodiment which differ from the embodiment in FIG. 9 to FIG. 11 in that, a lever (516) which engages with the engagement pin (421) and rotates when the developing means (43) slides is provided together with an operation axis (517) being formed at the fixed position thereof which rotates the engagement member (509) upwardly with the rotation of the lever (516).

With the above configuration, after the rotary drum (41) being set to the supporting frame body (5), the engagement pin (421) contacts the lever (516) (ref. FIG. 12) by engaging the protruded plate portion (417) (418) of the developing means (43) respectively with the guide grooves (505) (506) and by moving it toward the rotary drum (41), when being moved further, the operation axis (517) rotates the engagement member (509) anti-clockwise upwardly about the axis (513) by the anti-clockwise rotation of the lever (516) by the engagement pin (421) (ref. FIG. 13), whereby the engagement member (509) and the developing means (43) will be moved toward the rotary drum (41) drawn by the spring (515) at the uppermost position of the engagement member (509) (ref. FIG. 14). The relative positions of the developing means (43) and the rotary drum (41) will be ensured by the contact surfaces (507) (508) and the contact edges (419) (420) as same as the above embodiment. On the other hand, when dismounting the developing means (43) it may be drawn out after disengaging the engagement pin (421) from the concave (511) by pulling the engagement member (509) against the spring (515) and manually rotating downwardly.

Accordingly, in the present embodiment the developing means (43) may be mounted without manually rotating the engagement member (509) upwardly by stopping it during the mounting which enables the further improvement of the mounting operation of the developing means (43).

FIG. 15 to FIG. 19 are drawings showing the engagement mechanism of the developing means in another embodiment, which differ from the above embodiment in that, a handle (514*a*) extending to the opposite side of the axis (513) is formed at the end portion of the control axis (514) having a common press-down control part with the handle (514*a*) to the rear supporting wall (52), while an opening (19*a*) extending laterally is formed on the vertical rear plate (19) of the copying machine body (1), wherein a shape of the opening (19*a*) has such a configuration that the handle (514*a*) may be inserted therethrough only when the engagement member (509) faces properly with the handle (514*a*) aforementioned only when rotating upwardly.

Accordingly, in the embodiment the engagement of the developing means (43) may be accomplished as simply and accurately as the embodiment aforementioned.

At the setting condition of the developing means (43), since the engagement member (509) has rotated upwardly and the handle (514*a*) is properly facing the opening (19*a*) as a whole, the positioning at the fixed set position may be accomplished by pushing in the supporting frame body (5) and inserting the handle (514*a*) through the opening (19*a*), on the other hand, at the dismounting condition of the developing means (43), since the engagement member (509) has rotated downwardly and the handle (514*a*) is in a relative position with the opening (19*a*) as if being rotated by a fixed angle, when the supporting frame body (5) is pushed, the handle (514*a*) will be not inserted through the opening (19*a*) but contacts the rear vertical plate (19) thus the further advance to the fixed set position may be surely prevented. That is, the supporting frame body (5) may be pushed in as far as the fixed set position only when the developing means (43) has been set, accordingly the copy operation under the non-setting condition of the developing means will be prevented surely by the limit switch etc. Unillustrated which detects the full insertion to the fixed set position. Further, since the handle (514*a*) is protruded in the front and rear side of the supporting frame body (5) it is easy to handle and the engagement operation is extremely simple.

FIG. 20 is an exploded perspective view showing a relation between the rear supporting wall of the supporting frame body and the engagement member in another embodiment which differs from the embodiment in FIG. 15 to FIG. 19 in that, the handle (514*a*) may contact a peripheral of the opening (55) of the front vertical plate (18) by extending the handle (514*a*) of the engagement member (509) mounted on the side of the rear supporting wall (52) lengthily toward the axis (513) in contrast with the above embodiment and the opening (19*a*) in the rear vertical plate (19) being omitted. With the above configuration, the supporting frame body (5) can hardly be pushed in when the developing means is not set and the non-setting thereof may be distinguished immediately at a glance, moreover a damage to the handle (514*a*) caused by the strong impact given by the inertia may be also prevented since the moving distance of the supporting frame body (5) is small.

Moreover, the present invention is not limited to the above embodiment, it may, for instance, be possible to provide the engagement member (509) with a spring which gives constant impetus to rotate upwardly or to arrange the lever (516) which engages with the engagement pin and rotates in the configuration.

It is to be understood that other various modification in the design are possible without departing from the essential characteristics of the present invention.

As above, the present invention enables to simplify the engagement of the developing means by eliminating the screwing and the operation for retaining the developing means at the fixed position during the screwing, since the vertical positioning of the developing means is set by the guide which controls the vertical position against the rotary drum and the developing means is slidable toward the rotary drum by the spring with the engagement member rotated to the standard position engaging the engagement pin.

Further, fears of damaging the rotary drum etc. are entirely eliminated by controlling the direction of mounting the developing means in one direction. Moreover, a peculiar effect may be attained such as to avoid the mis-copying for certain by preventing the setting of the supporting frame body while the developing means is not being set.

The engagement of the developing means may be further simplified by eliminating the trouble to rotate the engagement member when it is arranged to rotate following the setting of the developing means.

What is claimed is:

1. An engagement mechanism for a developing means in an electrostatic copying machine characterized in that an original image is projected on a photoreceptor arranged on a rotary drum via a focusing device, forming an electrostatic latent image on said photoreceptor and positively changing the electrostatic latent image into a toner image by the developing means, said mechanism comprising a supporting part supporting the rotry drum in freely movable fashion, a contact surface controlling a horizontal position of the developing means, and a supporting member having a guide which controls a vertical position; said supporting part, said contact surface, and said supporting member being provided on a supporting frame body which can be drawn out from a vertical front plate of a copying machine body, an engagement member rotatable in one direction from the standard position and movable toward the rotary drum in the standard position and arranged with a constant impetus thereto separately from the supporting frame body, and an engagement part which moves the developing means toward the rotary drum by engaging with an engagement part arranged at a fixed position of the developing means and which is provided in a fixed position on said engagement member.

2. The engagement mechanism for the developing means in the electrostatic copying machine in accordance with the above claim 1, wherein the engagement member is rotated toward a standard position by a manual operation.

3. The engagement mechanism for the developing means in the electrostatic copying machine in accordance with the above claim 1, wherein the engagement member is rotated toward the standard position following a setting operation of the developing means.

4. The engagement mechanism for the developing means in the electrostatic copying machine in accordance with the above claim 3, wherein the engagement member is rotated toward the standard position by a lever actuated by the engagement part of the developing means.

5. The engagement mechanism for the developing means in the electrostatic copying machine in accordance with the above claim 2, wherein the engagement member includes a pivotal axis and a control axis which controls a pivotal action at intervals, whereby the control axis engages with a hook side of a hook-shaped aperture formed on a supporting wall of the supporting frame body and the pivotal axis engages with the other side thereof.

6. The engagement mechanism for the developing means in the electrostatic copying machine in accordance with claim 2, wherein a guided moving direction of the developing means by the guide is in parallel with a moving direction of the engagement member toward the rotary drum at the standard position.

7. The engagement mechanism for the developing means in the electrostatic copying machine in accordance with of the above claim 2, wherein the guide comprises a concave groove extending horizontally and engaging with a protruded plate portion formed at the front and rear surfaces of the developing means slidably.

8. The engagement mechanism for the developing means in the electrostatic copying machines in accordance with the above claim 1, wherein a press-down control part which prevents a push-in operation by engaging with the fixed position on the copying machine body at the rotation from the standard position, is formed at the fixed position of the engagement member.

9. The engagement mechanism for the developing means in the electrostatic copying machine in accordance with the above claim 8, wherein the press-down control part is formed at a rear supporting wall side of the supporting frame body and a hole for inserting through the press-down control part being formed at the standard position on a rear side plate of the copying machine body.

10. The engagement mechanism for the developing means in the electrostatic copying machine in accordance with the above claim 8, wherein the press-down control part is formed at the rear supporting wall side of the supporting frame body which, when rotating from the standard position, may prevent the push-in of the supporting frame body by engaging with a peripheral of an opening for inserting through the supporting frame body formed on the front side wall of the copying machine body.

11. The engagement mechanism for the developing means in the electrostatic copying machine in accordance with the above claim 9, wherein the press-down control part is protruded to the rear side of the rear supporting wall of the supporting frame body.

12. The engagement mechanism for the developing means in the electrostatic copying machine in accordance with the above claim 9, wherein the press-down control part is formed at the end of the control axis of the engagement member.

13. The engagement mechanism for the developing means in the electrostatic copying machine in accordance with the above claim 9, wherein the press-down control part serves also as a handle for rotating the engagement member.

* * * * *